United States Patent [19]

Fischer

[11] 3,985,996

[45] Oct. 12, 1976

[54] THERMAL CUTTING APPARATUS

[76] Inventor: Artur Fischer, Altheimer Str. 219, D-7241 Tumlingen, Germany

[22] Filed: Feb. 13, 1975

[21] Appl. No.: 549,023

Related U.S. Application Data

[63] Continuation-in-part of Ser. No. 522,931, Nov. 11, 1974.

[30] Foreign Application Priority Data

Nov. 17, 1973 Germany ..... 2357527

[52] U.S. Cl. ..... 219/221; 30/116; 30/140; 83/171; 219/233; 219/533; 225/93.5

[51] Int. Cl.[2] ..... H05B 1/00; B26D 7/10; B26F 3/12

[58] Field of Search ..... 219/221, 227, 229, 230, 219/233, 235, 240, 533; 83/170, 171, 16; 30/116, 117, 140; 128/303.1, 303.14; 225/93.5

[56] References Cited

UNITED STATES PATENTS

| | | | |
|---|---|---|---|
| 1,130,373 | 3/1915 | Bright | 225/93.5 |
| 2,476,612 | 7/1949 | Lobdell | 219/240 |
| 2,476,680 | 7/1949 | Norgard | 225/93.5 |
| 2,734,986 | 2/1956 | Gameros | 219/240 |
| 2,749,608 | 6/1956 | Siemer | 83/171 X |
| 3,338,122 | 8/1967 | Lampe | 83/171 X |
| 3,711,677 | 1/1973 | Cummins | 219/221 |

FOREIGN PATENTS OR APPLICATIONS

| | | | |
|---|---|---|---|
| 1,526,100 | 4/1968 | France | 219/221 |

*Primary Examiner*—A. Bartis
*Attorney, Agent, or Firm*—Michael J. Striker

[57] ABSTRACT

An apparatus for cutting arbitrary shapes in material, particularly in synthetic plastic foam material, comprises a bendable, shape-retaining, electrically conductive resistive wire. The wire may be successively formed into any desired form factor by selectively arranging either or both elements of a pair of independently movable electrically non-conductive wire-positioning elements which are respectively connected to end portions of the wire. The wire cuts the desired shape by the heat produced by connecting the wire to an electrical current source which heats the wire to a sufficiently high temperature. Securing portions are respectively provided on the movable wire-positioning elements so that the latter may be fixedly positioned and form an interlocked assembly, whereby the wire may be positioned into a narrow loop and thereby cut circular patterns into a series of workpieces. An electrical switch is provided in the electrical circuit path adjacent one of the end portions of the wire, on either one of the wire-positioning elements, or, on an extension member which is mechanically and electrically connected with a wire-positioning element; the switch being operative to complete the electrical circuit path.

9 Claims, 2 Drawing Figures

THERMAL CUTTING APPARATUS

CROSS-REFERENCE TO A RELATED PATENT APPLICATION

The present application is a continuation-in-part application of the parent application having Ser. No. 522,931 filed on Nov. 11, 1974.

BACKGROUND OF THE INVENTION

The present invention relates to an apparatus for cutting arbitrary shapes into material, and more particularly to cutting arbitrary shapes in synthetic plastic foam material, such as styrofoam or polystyrene.

Heating resistive wires, such as "constantan," is known in the prior art: passing sufficient current through a resistive wire brings the wire to temperatures in the range from 200° C through 300° C. This heat range has been found to be sufficient to cut synthetic plastic foam material, such as styrofoam. The prior art cutting devices, however, have the disadvantage of having the single capability of cutting straight line patterns. Specifically, the wire of the prior art is extended across two bracket arms while the workpiece is guided towards the extended wire, or, the workpiece may be kept stationary and the wire may be moved relative thereto.

A disadvantage of these cutting devices of the prior art is that they are restricted to cutting linear patterns only. There is no capability for cutting curvilinear or closed line patterns, such as circles or bore holes. In applications such as modelling landscape scenes, it is extremely important to create a true-to-life setting; hence, the single capability of cutting either horizontal or vertical lines severely restricts the various applications to which the synthetic plastic foam material shapes can be utilized.

Furthermore, the prior art does not teach, nor provide, for any readily operable desired interruption of the electrical heating current flow for the sake of the convenience of the operator, or, for the termination of the cutting function. Thus, an unnecessary current drain from a supply source will result. This is especially disadvantageous when batteries are used, since such a supply source has a limited current storage capability.

Furthermore, the electrical switch provides for operator safety. The resistive wires of the prior art are supported by electrically conductive support clamps which are respectively mounted on the wire-positioning elements. If interruption of the electric current flow were desired, the operator has to unclip these clamps. Inasmuch as the clamps were not only uninsulated from the electrical current, but were moreover still hot, the operator found it convenient to omit the step of unclipping the clamps; thus increasing the aforementioned current drain.

SUMMARY OF THE INVENTION

Accordingly, it is a general object of the present invention to overcome the disadvantages of the prior art.

More particularly, it is an object of the present invention to provide a cutting apparatus which can be so arranged so as to successively cut arbitrarily shaped pieces into synthetic plastic foam material as desired.

An additional object of the present invention is to provide a cutting apparatus which can fixedly position a resistive cutting wire into a loop, so that bore holes and closed line patterns may be cut into a series of synthetic plastic foam material workpieces.

Another object of the present invention is to prevent unnecessary current consumption.

A further object of the present invention is to provide for operator safety.

In keeping with these objects and others which will become apparent hereinafter, one feature of the present invention is the independent movability of the pair of electrically non-conductive wire-positioning elements. Each of these elements is connected to spaced end portions of a bendable, shape-retaining resistive wire. By bending the wire into any desired position by moving either or both of the pair of wire-positioning elements, any curvilinear pattern may be cut. Furthermore, by extending the wire-positioning elements into a vertical or a horizontal orientation, it is also possible to cut linear patterns.

Another feature of the present invention is the passing of electrical current through the resistive wire so that temperatures in the range from 200° C are achieved. This allows the synthetic plastic foam material to be cut so quickly that the wire does not lose its rigidity during the cutting process and, moreover, a groove or a bore hole may be cut without the collapse or additional trimming of the surrounding portions of synthetic plastic material.

An additional feature of the present invention is to provide releasable supporting clamps which are respectively connected to the spaced end portions of the wire and are releasably clamped to each of the wire-positioning elements. If during a cutting operation a wire is desired to be changed for maintenance purposes, then the wire may be unclipped from the wire-positioning elements without disturbing their relative orientation.

Yet a further feature of the present invention is to provide that each wire-positioning element has a securing portion which cooperates with each other, so that an interlocked but releasable assembly may be achieved. When so interlocked, the resistive wire is fixed in a looped pattern. If, subsequently, the wire-positioning elements are rotated, and the bight portion of the loop of the wire engages the synthetic plastic foam material in a substantially perpendicular direction, a circular pattern such as a bore hole may be cut therein. By varying the size of the bight portion of the loop and its direction with respect to the synthetic plastic foam material workpiece, different diameters and different angles of entry may be achieved.

Another feature of the present invention is to provide an electrical switch adjacent one of the end portions of the wire. The electrical switch is operative to complete an electric circuit path. This feature assures that the heating current will flow only when the switch is actuated. The switch can be actuated just prior to the start of a cutting operation, and deactuated immediately after cutting is complete so that excess current is not wasted. Furthermore, this feature provides for operator safety. An operator need no longer interrupt the electrical circuit path by grabbing hold of an electrically-alive and still hot electrically-conductive clamp.

Another feature of the present invention is to provide the switch on an extension member. The extension member has a socket which is adapted to cooperate with a connecting pin provided on an end portion of a wire-positioning element so that both an electrical and a mechanical connection is simultaneously established. This feature assures maximum versatility in the use of various sized wire-positioning elements and in the interchangeable use of various electrical switches of different loading capacities.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
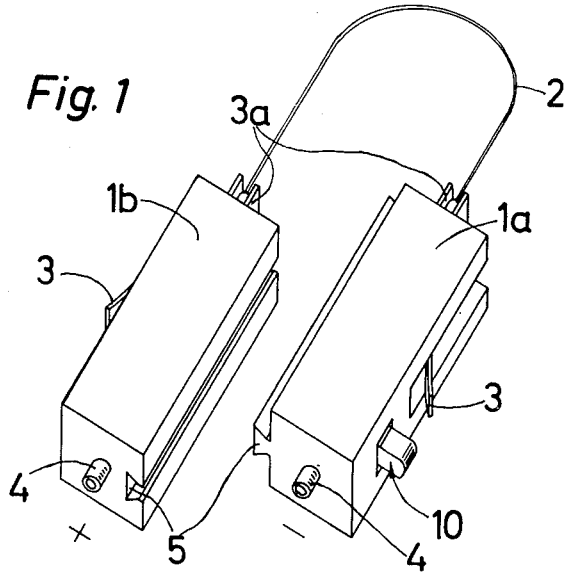
FIG. 1 is a perspective view of a cutting apparatus according to the present invention showing the wire positioned in an arbitrary shape.
Figure 2:
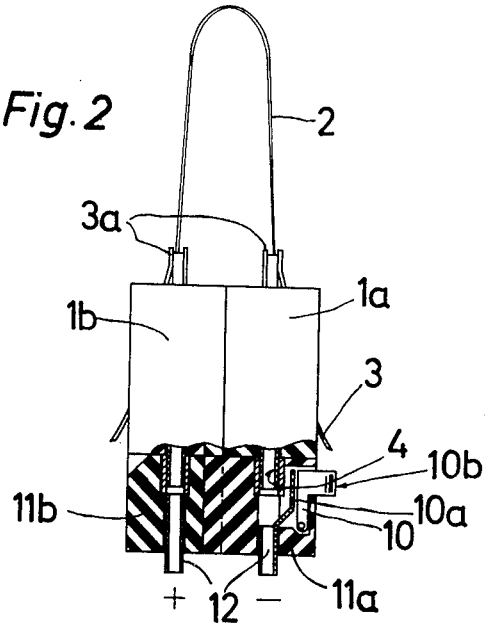
FIG. 2 is a partially sectioned view of a cutting apparatus according to the present invention showing the wire-positioning elements secured to each other and the electrical switch.

Discussing the cutting apparatus which has been illustrated in an exemplary embodiment in FIGS. 1 and 2, it will be seen that reference numerals 1*a* and 1*b* identify respectively the independently movable wire-positioning elements. The bendable, shape-retaining resistive wire 2, which is bendable to form a desired workpiece-cutting configuration but is stiff enough to retain the wire in the configuration to which it has been bent, is respectively connected to each of the movable elements, so that the wire may be bent into any desired position by moving either or both elements 1*a* and/or 1*b*.

The support clamps or clips 3 are releasably connected to the end portions of the resistive wire 2 and are, in turn, supported by the elements 1*a*, 1*b*. One end of each of the support clamps 3*a* overhangs the elements 1*a*, 1*b*, and, at the other end of the support clamps 3, current carrying wires or connecting pins 4 conduct current from an electrical current source (not illustrated) towards the resistive wire 2.

As noted above, the wire-positioning elements may be individually positioned, or may be secured with respect to each other so as to prevent one from moving relative to the other. To accomplish this, the elements 1*a* and 1*b* have cooperating securing portions 5 which establish an interlocked but releasable assembly. Preferably, one cooperating portion 5 on element 1*b* is an undercut V-shaped groove, and its cooperating portion 5 on element 1*a* is an undercut V-shaped projection. Of course, it is understood that each of the securing portions 5 may be alternately located on the other element and not detract in any way from the spirit of the present invention.

An electrical switch 10 is provided in the electric circuit path intermediate the connecting pin and the wire 2 and is operative to connect or disconnect the current flowing from the current source towards the wire 2. The switch 10 may be located on either wire-positioning element; for example, the switch is located on element 1*a* in FIG. 1. The connecting pin illustrated on element 1*b* is directly connected to the wire 2; no other switch being necessary than switch 10 to actuate and complete the circuit path. The switch 10 may be any type of electric switch and is preferably a normally open pushbutton switch which is operative by being manually depressed.

In the operation as depicted in FIG. 1, the wire-positioning elements 1*a*, 1*b* are each independently movably with respect to each other. In other words, both elements may be moved with respect to one another or either element 1*a* or 1*b* may be fixedly located while the other element is moved with respect thereto.

It is the selective positioning by the movable elements 1*a*, 1*b* which bends and positions the wire 2 into any desired shape. By passing electrical current through the resistive wire to a sufficiently elevated temperature, the workpiece may be cut by engaging the heated wire with the workpiece. The wire rapidly melts the synthetic plastic foam material; thus, no additional supports which would hinder the heating of the cutting wire are needed.

An electrical current source with a pair of associated electric cables may be connected to a first connecting pin 4 provided on element 1*a* and to a second connecting pin 4 provided on element 1*b*. It is evident that the heating current will only flow towards the wire 2 when the switch 10 is actuated. This action may be taken at any time for the convenience of an operator, or may be taken immediately prior to the cutting operation. After finishing the cutting operation, the cutting apparatus may be put aside and the pushbutton deactuated, whereupon the electric circuit path will be interrupted, thereby preventing unnecessary current drain.

In FIG. 2, the wire-positioning elements 1*a* and 1*b* are fixedly secured with respect to each other by the cooperating securing portions 5. The projection 5 provided on element 1*a* is slidably inserted into the cooperating groove provided on element 1*b*. The undercut or V-shaped configuration of the securing elements assures that outward movement of the wire-positioning elements 1*a* and 1*b* is prevented by the abutting lateral edges of the mating pieces. If a substitution of the wire 2 becomes necessary for maintenance reasons or during the course of a mass-production run, the supporting clamps 3 may be unclipped from the elements 1*a* and 1*b* in order to release the wire 2.

The wire 2 is shape-retaining but bendable. Constantan may be employed and is preferably heated to a predetermined temperature range from about 200° C to 300° C.

The wire-positioning elements 1*a*, 1*b* are formed from any electrically insulating material, such as synthetic plastic material which will not melt or otherwise deform when subjected to electrical current or temperatures greater than the range disclosed.

The switch 10 is located on a first extension member 11*a*, in contrast to the switch 10 being provided on the wire-positioning element 1*a*, as illustrated in FIG. 1. The first extension member 11*a* is provided with an electrically conductive first socket provided at one of its ends and a first electrically conductive terminal 12 provided at its opposite end. The first connecting pin 4 provided on element 1*a* is adapted to be inserted into the first socket of extension member 11*a* in a manner so that a mechanical and an electrical connection therebetween is accomplished. This is accomplished primarily by frictional interengagement between the first connecting pin 4 and the first socket.

The switch 10 is provided on extension member 11*a* intermediate the first terminal 12 and the first socket/-first connecting pin interengagement. An electrically conductive resilient tongue 10*a* is provided adjacent the button 10*b*. The tongue normally assumes a first position in which it lies out of electrical contact with the circuit path and, when depressed by the button 10*b*, assumes a second position in which the tongue establishes electrical contact with the circuit path and bridges the first terminal 12 with the first connecting pin/first socket interengagement, so that current may thereby flow towards the wire 2. At an opposite end of the button 10*b*, a pivot pin is provided to support the switch 10 during its movement in and out of the circuit path. The tongue 10*a* may be directly connected with the first terminal 12, so that only one free end portion of the tongue need be depressed into conductive contact with the first connecting pin/first socket subassembly. The resilient tongue 10*a* may also be provided with a spring or any equivalent means for normally biasing the tongue 10*a* out of electrical contact with the circuit when the cutting apparatus is not desired to be used.

A second extension member 11*b* may be located adjacent to the first extension member 11*a*. The second extension member 11*b* corresponds to the external measurements of the first extension member and is similarly provided with a second electrically conductive socket at one of its ends which cooperates with a second connecting pin 4 which is provided on element 1*b*. As noted above for extension member 11*a* and element 1*a*, a strong mechanical and electrical connection is made by this frictional insertion. The second extension member 11*b* is further provided with a second electrically conductive terminal 12 at the other of its ends which together with the first terminal 12 are adapted to be connected to a current source. Extension member 11*b* is provided not only for aesthetic reasons, but also for ease in connecting the terminals 12 to a current source.

The device illustrated in FIG. 2 is especially useful for cutting bore holes and circular patterns into a workpiece. Inasmuch as the two wire-positioning elements 1*a*, 1*b* are both fixed with respect to each other, a narrow loop may be formed. The bight portion of the loop may be positioned to engage a workpiece in a substantially perpendicular manner, so that, by turning the elements 1*a*, 1*b* together by means of a rotary motion, the wire 2 will cut a closed pattern into a workpiece.

Furthermore, mass production techniques which require identifical designs to be cut into a series of workpieces are especially advantageously formed if the wire is positioned as illustrated in FIG. 2.

It will be understood that each of the elements described above, or two or more together, may also find a useful application in other types of apparatus for cutting differing from the types described above.

While the invention has been illustrated and described as embodied in an apparatus for cutting, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, farily constitute essential characteristics of the generic or specific aspects of this invention.

What is claimed as new and desired to be protected by Letters Patent is set forth in the appended claims:

1. A cutting apparatus for cutting shapes in workpieces, particularly synthetic plastic foam material, comprising an electrically conductive, resistive wire having spaced end portions and being bendable to form a desired workpiece-cutting configuration but being stiff enough to retain the wire in said configuration to which it has been bent; a pair of electrically non-conductive, wire-positioning elements each connected to a respective one of said wire end portions, said elements being independently movable so that they may be successively moved and positioned to form said wire into said configuration requisite for cutting different shapes into a workpiece; means for supplying electrical current to said wire so as to form an electrical circuit path for heating said wire to a predetermined cutting temperature, said current supplying means including an electric switch provided in said path adjacent one of said spaced end portions of said wire and operative to close said circuit path; a pair of extension members; and mounting means for connecting said extension members with said elements, said current supplying means further including a pair of cooperating electrically-conductive pins and sockets on respective ones of said elements and extension members for establishing a mechanical and electrical interconnection therebetween and an electrically conductive terminal on each of said extension members electrically connected to the pin and socket interconnection between the member and its associated element.

2. A cutting apparatus as defined in claim 1, wherein said switch is a normally open pushbutton switch and is operative to complete said electrical circuit path when said switch is manually depressed.

3. A cutting apparatus as defined in claim 1, wherein said switch is provided on one of said wire-positioning elements in the circuit between the terminal and the pin and socket interconnection.

4. A cutting apparatus as defined in claim 1, wherein said mounting means comprises a first connecting pin provided on one of said wire-positioning elements, and a second connecting pin provided on the other of said wire-positioning elements.

5. A cutting apparatus as defined in claim 1, and further comprising coupling means on each of said wire-positioning elements meshing and mutually engageable with one another for fixing said elements to each other and thus securing a stable interrelationship and a predetermined loop-shaped configuration of the wire so as to enable the wire to cut a series of identical cutting shapes in the workpieces.

6. A cutting apparatus for cutting shapes in workpieces, particularly synthetic plastic foam material, comprising an electrically conductive, resistive wire having spaced end portions and being bendable to form a desired workpiece-cutting configuration but being stiff enough to retain the wire in said configuration to which it has been bent; a pair of electrically non-conductive, wire-positioning elements each connected to a respective one of said wire end portions, said elements being independently movable so that they may be successively moved and positioned to form said wire into said configuration requisite for cutting different shapes into a workpiece; means for supplying electrical current to said wires so as to form an electrical circuit path for heating said wire to a predetermined cutting temperature, said current supplying means including first and second connecting pins provided on respective ones of said wire-positioning elements; an electric switch provided in said path adjacent one of said spaced end portions of said wire and operative to close said circuit path; and an extension member having opposite ends, an electrically conductive socket provided at one of said ends of said extension member connectable with said first connecting pin so as to cooperatively establish a mechanical and electrical connection, and an electrically conductive terminal provided at the other of said ends of said extension member and electrically connected to said socket.

7. A cutting apparatus as defined in claim 6, wherein said switch is provided on said extension member in the circuit between said terminal and said socket.

8. A cutting apparatus as defined in claim 7, wherein said switch comprises an electrically-conductive resilient tongue having a fixed portion electrically connected with said terminal, and a movable contact portion normally overlying said socket; said switch further comprising means for moving said contact portion between respective positions in which said contact portion is alternately in and out of engagement with said socket so as to respectively establish and interrupt the flow of electrical current towards said wire.

9. A cutting apparatus as defined in claim 6, and further comprising an additional extension member located adjacent said first-mentioned extension member, said additional extension member having opposite ends and being provided with an electrically-conductive socket at one of its ends which cooperates with said second connecting pin so as to establish a mechanical and electrical connection therewith, and an electrically-conductive terminal at the other of said ends of said additional extension member and electrically connected to said socket.

* * * * *